US007242361B2

(12) United States Patent
Kronberger

(10) Patent No.: US 7,242,361 B2
(45) Date of Patent: Jul. 10, 2007

(54) ANTENNA STRUCTURE WITH FILTER EFFECT

(75) Inventor: Rainer Kronberger, Würselen (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/148,133

(22) Filed: Jun. 8, 2005

(65) Prior Publication Data

US 2006/0119530 A1 Jun. 8, 2006

(30) Foreign Application Priority Data

Jun. 8, 2004 (DE) ..... 10 2004 027 839

(51) Int. Cl.
*H01Q 9/28* (2006.01)

(52) U.S. Cl. ..... 343/795; 343/866

(58) Field of Classification Search ..... 343/795, 343/803, 741, 742, 866, 867
See application file for complete search history.

(56) References Cited

U.S. PATENT DOCUMENTS 2,511,574 A * 6/1950 Finneburgh, Jr. et al. ... 343/816
2,714,053 A * 7/1955 Herbert et al. ..... 423/116
2,724,053 A * 11/1955 Davis ..... 343/803
4,987,424 A * 1/1991 Tamura et al. ..... 343/795
6,285,342 B1 * 9/2001 Brady et al. ..... 343/895
6,292,154 B1 * 9/2001 Deguchi et al. ..... 343/806
6,961,028 B2 * 11/2005 Joy et al. ..... 343/895

FOREIGN PATENT DOCUMENTS

WO 2004042868 A1 5/2004

OTHER PUBLICATIONS

Karl Rothammel, Antennenbuch, Y2 1 BK, pp. 108-123.

* cited by examiner

*Primary Examiner*—Tan Ho
(74) *Attorney, Agent, or Firm*—Baker Botts L.L.P.

(57) ABSTRACT

An antenna structure for transmitting and/or receiving radio waves has a symmetrically arranged radiator element with a first connecting terminal and a second connecting terminal, said radiator element being tuned to a useful frequency. Moreover, it has at least one conductor structure connected in parallel with the radiator element. The conductor structure comprises an open-circuited first line element, which is coupled to the first connecting terminal, and an open-circuited second line element, which is coupled to the second connecting terminal. In this case, a length of the first line element and of the second line element essentially corresponds to the integral multiple of a quarter wavelength corresponding to a blocking frequency. The first line element and the second line element run parallel to one another.

23 Claims, 2 Drawing Sheets

ANTENNA STRUCTURE WITH FILTER EFFECT

CROSS-REFERENCE TO RELATED APPLICATION

This application claims priority from German Patent Application No. 10 2004 027 839.3, which was filed on Jun. 8, 2004, and is incorporated herein by reference in its entirety.

TECHNICAL FIELD

The present invention relates to an antenna structure for transmitting and/or receiving radio waves.

BACKGROUND

An antenna structure is often configured in such a way that it has an asymmetrical structure. In this case, a radiator, such as an electrical monopole, for example, is connected with respect to a ground connection. The antenna structure is usually matched to an output resistance of a transmitting stage of 50 ohms or an input resistance of a receiving stage of 50 ohms. Since, particularly in integrated circuits, the transmitting stage generally has a differential—that is to say symmetrical—output, it is necessary to connect at least one transformer between the asymmetrical antenna structure and the transmitting stage. The transformer converts the output signals of the transmitting stage, so that these can be fed to the antenna structure. Connecting a transformer into the transmitting path causes undesirable power losses, however. A corresponding measure in the form of a transformer between the receiving stage and the antenna structure is provided in the receiving path since the receiving stage quite generally likewise has differential and thus symmetrical inputs.

In order to suppress an emission of undesirable harmonics by the transmitting stage, a filter is inserted between the transmitting stage and the antenna structure. Said filter usually has a high-pass, low-pass or bandpass behavior. Inserting the filter is necessary in order to emit an as far as possible monofrequency and low-noise signal. A filter is equally present in the receiving path between the antenna structure and the receiving stage, which filter reduces undesirable out-of-band signals from the reception signal which have an interfering effect on a preamplifier and mixer. The presence of the filters is associated with the disadvantage of undesirable power losses. These are referred to as insertion losses.

A further disadvantage arises in the case of a DC supply of the transmitting stage via the center tap of a symmetrical transformer. Such a transformer is configured in such a way as to effect a transformation to the asymmetrically embodied antenna structure. The transformer can thus be connected in parallel with the antenna structure. With an additional external capacitor, it is possible in this way to effect a filter blocking effect outside the useful band. A known arrangement of a transmitting stage with differential outputs, an asymmetrical antenna structure and a transformer is known in Bluetooth transceivers or similar transmission devices; the Bluetooth transceiver PMB8761 from the company Infineon shall be mentioned by way of example. The transformer is a wire-wound ferrite element associated with high production costs. Due to the poor material properties of the ferrites at high frequencies, i.e. at frequencies in the range of more than 1 GHz, the losses of the transformers usually increase considerably, which often leads to considerable insertion losses in the transmitting and/or receiving path. This causes a significant impairment of the performance of the overall system.

SUMMARY

The present invention is based on the problem of providing a lower-loss antenna structure with a filter effect that can be connected to a differential input or output of a transmitter or receiver.

The antenna structure for transmitting and/or receiving radio waves has a symmetrically arranged radiator element with a first connecting terminal and a second connecting terminal, said radiator element being tuned to a useful frequency, and at least one conductor structure—connected in parallel with the radiator element—with an open-circuited first line element which is counted to the first connecting terminal, and an open-circuited second line element, which is coupled to the second connecting terminal, the first line element and the second line element being of the same length and the length of the first line element and of the second line element essentially corresponding to the integral multiple of a quarter of a wavelength corresponding to a blocking frequency, and the first line element and the second line element being arranged in a manner running parallel to one another.

The first line element and the second line element are for example lines or conductor tracks.

The conductor structure has a filter effect as a result of the two open-circuited line elements connected in parallel with the radiator element. Components in the region of the blocking frequency are filtered out by the choice of the length of the open-circuited line elements. This is due to the fact that the open-circuited line elements, connected up in parallel with a radiator element, have a blocking or filter effect when their electrical length is an integral multiple of the quarter wavelength of a blocking frequency. To illustrate it clearly, the open circuit, at the end of the line elements, is transformed into a short circuit as a result of the length of the line elements.

Since the open-circuited line elements are connected to connecting terminals of the symmetrical radiator element with different polarity, currents that are in antiphase with respect to one another always flow through them. The parallel course of the open-circuited line elements has the effect that the conductor structure does not emit any power. The conductor structure thus corresponds to a nonradiative filter element. As a result, by virtue of the conductor structure, the antenna structure has a filter element that causes virtually no additional power losses.

It is additionally an advantage of the present invention that the conductor structure does not influence the radiation behavior of the radiator element by virtue of the lack of power emission.

The symmetrical radiator element means that no transformers are necessary in order to connect the antenna structure to a differential input or output of a transmitting or receiving stage. In an advantageous manner, the antenna structure can thus be connected directly thereto.

A further advantage is that the impedance level of the transmitting and receiving stage can be matched to the jointly most favorable value.

In one development of the present invention, the antenna structure has at least one further, second conductor structure—connected in parallel with the radiator element—with an open-circuited third line element, which is coupled to the first connecting terminal, and an open-circuited fourth line element, which is coupled to the second connecting terminal. In this case, the third line element and the fourth line element are of the same length and the length of the third line element and of the fourth line element essentially corresponds to the integral multiple of a quarter of a wavelength corresponding to a second blocking frequency different from the blocking frequency.

What is advantageous about this development is that a further nonradiative filter element is thus connected in parallel with the radiator element, which filters out signals at a second blocking frequency. The blocking frequency and the second blocking frequency are chosen in the frequency range of useful frequencies of radio systems operating in relatively close proximity, which thus represent significant interference sources.

The radiator element is typically designed as a folded dipole.

In a further refinement, the radiator element is embodied as a folded dipole in angular form. It can thus be arranged around a transmitting or receiving stage in a space-saving manner.

This refinement of the antenna structure is additionally advantageous because the zeros of a folded dipole that are present in the limb direction in the radiation characteristic are avoided in this case.

In an additional refinement, the radiator element is embodied as a symmetrical frame antenna with a closed border.

In a further embodiment, the radiator element is embodied as an approximately fractal structure generated by a finite number of iteration steps generating a partial fractal. Such a structure may be for example a Hilbert area generated by a finite number of iteration steps or a Koch curve generated by a few iteration steps. Further radiator elements of this type are also conceivable, which are referred to as fractal antennas. These are associated with the advantage that they have good receiving or transmitting properties at different frequency bands. They are therefore particularly suitable for broadband transmission systems.

In another development, the radiator element is embodied as a line in meandering form. As a result, a high electrical length is obtained and a low frequency corresponding thereto is received or transmitted in conjunction with a small space requirement of the radiator element.

In one refinement of the present invention, the conductor structure is embodied as an approximately fractal structure generated by a finite number of iteration steps generating a partial fractal. It is thus advantageously possible to bring about a blocking effect over a wide frequency band.

In a further refinement of the present invention, the conductor structure is embodied as first line element and second line element running parallel in meandering form.

In a preferred refinement of the antenna structure, the conductor structure is arranged within an area bounded by the radiator element. This arrangement enables a compact and space-saving embodiment of the antenna structure.

In an alternative refinement of the antenna structure, the conductor structure is arranged outside an area bounded by the radiator element.

In one development of the present invention, a symmetrical radiator element has a connection for feeding a DC voltage into the radiator element. This means that an additional external transformer is not necessary, which leads to lower production costs for the overall arrangement. In this case, it is additionally advantageous that there is no need to provide an additional transformer for connection to the differential outputs or inputs of the transmitting or receiving stage.

In one possible embodiment, the antenna structure is integrated in a housing of a semiconductor component. The joint integration into a semiconductor component enables a simple implementation and also the connection of further switching elements, such as of input filters for example, into the same semiconductor component. It is also possible to integrate the transmitting or receiving stage together with the antenna structure into a semiconductor component.

If the antenna structure is integrated in printed form on a printed circuit board, the modules of the transmitting or receiving stage can advantageously be added on the same printed circuit board.

Printing on printed circuit boards is a cost-effective and low-complexity method for the production of structures. A further advantage thus consists in the fact that a high degree of flexibility is possible in the configuration and the tuning of the antenna structure.

The invention is explained in more detail below using exemplary embodiments with reference to the drawing.

DETAILED DESCRIPTION

Figure 1:
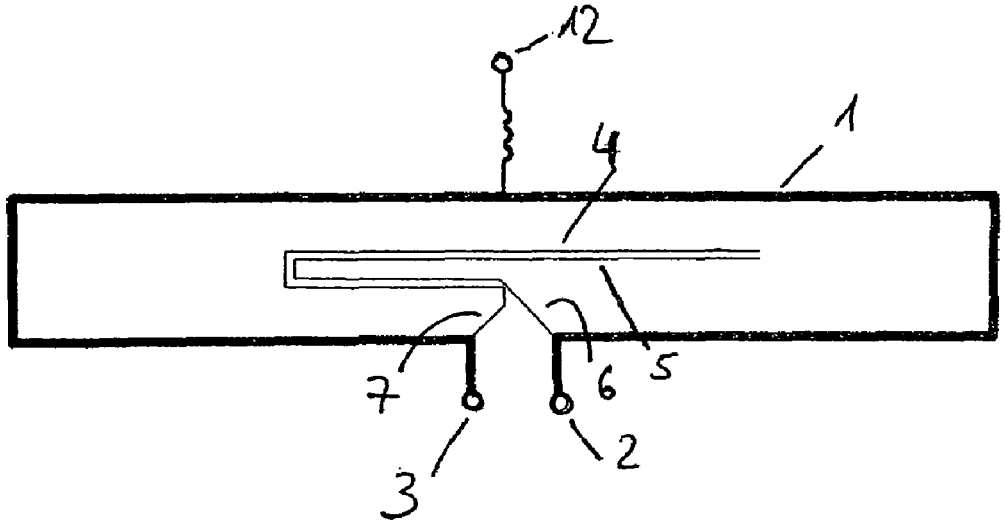
FIG. 1 shows an embodiment of an antenna structure according to the invention.

FIG. 1 shows an embodiment of an antenna structure according to the invention. A radiator element 1 is embodied in the form of a symmetrical folded dipole having a first connecting terminal 2 and a second connecting terminal 3. A meandering dipole or dipole embodied in fractal fashion would also be conceivable as an alternative. These embodiments are not illustrated in the drawing.

The symmetrical folded dipole is designed in such a way that it transmits or receives radio waves at a useful frequency $f_N$. This takes place for example by virtue of the fact that the electrical length of the folded dipole, which corresponds to the lateral extent thereof, represents half a wavelength which corresponds to the useful frequency $f_N$.

An open-circuited first line element 4, which runs within an area bounded by the radiator element 1, is connected to the first connecting terminal 2 by means of a connecting line 6. An open-circuited second line element 5 is connected to the second connecting terminal 3 by means of a connecting line 7. A symmetrical conductor structure is thus formed from the first line element 4 and the second line element 5. In this case, the second line element 5 runs parallel to the first line element 4 within the area bounded by the radiator element 1. It has the same length as the first line element 4. The common length of the first line element 4 and of the second line element 5 corresponds to the electrical length of the conductor structure. The electrical length of the conductor structure is the integral multiple of the quarter of a wavelength which corresponds to a first blocking frequency $f_{s1}$. In this case, the first blocking frequency $f_{s1}$ differs from the useful frequency $f_N$ of the radiator element. The difference between the first blocking frequency $f_{s1}$, and the useful frequency $f_N$ typically amounts to at least 10% of the smaller of the two frequencies.

The first blocking frequency $f_{s1}$ is preferably chosen in such a way that it corresponds to a transmission frequency of a radio system that operates in the vicinity and causes interference. As a result, by means of the conductor structure it is possible to suppress a substantial interference signal component in a radio system having the antenna structure. This holds true in particular for different radio systems that utilize an adjacent or identical frequency range. An example of this is the so-called ISM band at approximately 2.4 GHz. Bluetooth or WLAN systems, for example, transmit on this band. In this case, the absolute difference between the useful frequency $f_N$ and the first blocking frequency $f_{s1}$, should typically be greater than or equal to 10% of the blocking frequency.

$$|f_N - f_{s1}| \leqq 10\% f_{s1} \quad (1)$$

This ensures that the conductor structure does not suppress items of information transmitted on the useful band with its blocking effect. In the case of a radio system operating on the ISM band, the blocking frequency may also be defined in the range of the GSM band, as at approximately 900 MHz to 1.9 GHz. Further conductor structures may filter out additional frequency ranges.

The first line element 4 and the second line element 5 are arranged as a two-wire line structure in a manner running with respect to one another in such a way that an electric field preferably forms between the conductor elements. Since the first line element 4 and the second line element 5 in each case couple to connecting terminals with different polarity, currents that are in antiphase with respect to one another flow through them. As a result of this, the electromagnetic field of the conductor structure is essentially identical to zero. Therefore, the conductor structure emits essentially no energy.

The conductor structure is spaced apart from the radiator element 1 in such a way that it couples only insignificantly to the electromagnetic field transmitted by the radiator element. This distance is determined by the electrical field of the conductor structure. The distance between the conductor structure and the radiator element 1 is typically greater than double the distance between the first line element 4 and the second line element 5.

In the embodiment illustrated, the conductor structure has a mechanical length that is less than the mechanical length of the radiator element. Consequently, the conductor structure can be arranged within the area bounded by the radiator element 1 without any further measures. The first blocking frequency $f_{s1}$ is greater than the useful frequency $f_N$.

It is likewise conceivable to arrange the conductor structure outside the area bounded by the radiator element 1. This arrangement is advantageous when the electrical length of the conductor structure is greater than the electrical length of the radiator element 1. Associated with this is a first blocking frequency $f_{s1}$ that is less than the useful frequency $f_N$.

The conductor structure may also be arranged in a plane that differs from a plane described by the radiator element.

At the midpoint of the folded branch of the folded dipole, a feeding-in connection 12 is coupled to the radiator element 1 via a coil element, that is to say inductively. A radio frequency voltage is not present at the midpoint at any point in time on account of the symmetry of the folded dipole. Therefore, this spot is also referred to as the "cold spot" of the antenna. The feeding-in connection 12 enables a DC supply of a transmitting or receiving stage coupled to the antenna structure.

Figure 2:
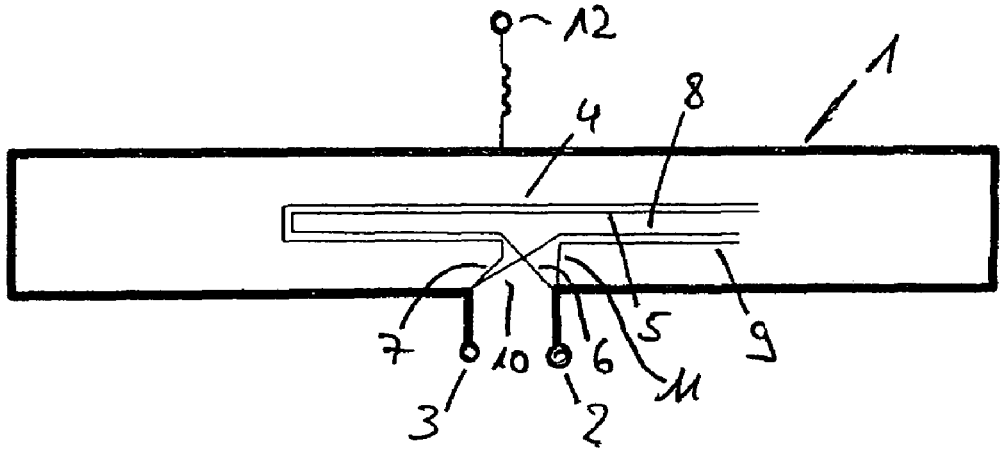
FIG. 2 shows an embodiment of an antenna structure according to the invention with a second conductor structure.

FIG. 2 shows the embodiment of an antenna structure according to the invention as illustrated in FIG. 1 with an additional, second conductor structure. The embodiment in FIG. 2 differs from the embodiment in FIG. 1 in that a third line element 8 is provided, which runs within the area bounded by the radiator element 1. The third line element 8 is coupled to the second connecting terminal 3 via a third connecting line 10. Furthermore, a fourth line element 9 running in the area bounded by the radiator element 1 is provided, and is coupled to the first connecting terminal 2 by means of a fourth connecting line 11. The third line element 8 and the fourth line element 9 are of the same length and run parallel to one another. The length of the third line element 8 and of the fourth line element 9 is tuned to an integral multiple of a quarter of a wavelength which corresponds to a second blocking frequency $f_{s2}$. The second blocking frequency $f_{s2}$ differs from the first blocking frequency $f_{s1}$ and the useful frequency $f_N$. The third line element 8 and the fourth line element 9 together form the second conductor structure. In this case, the second conductor structure is arranged in such a way that it does not couple with its electromagnetic field to the radiator element and the conductor structure formed from the first line element 4 and the second line element 5. It is thus spaced apart sufficiently from both.

The second blocking frequency $f_{s2}$ is preferably chosen in such a way that it corresponds to a further transmission frequency of an adjacent radio system.

Figure 3:
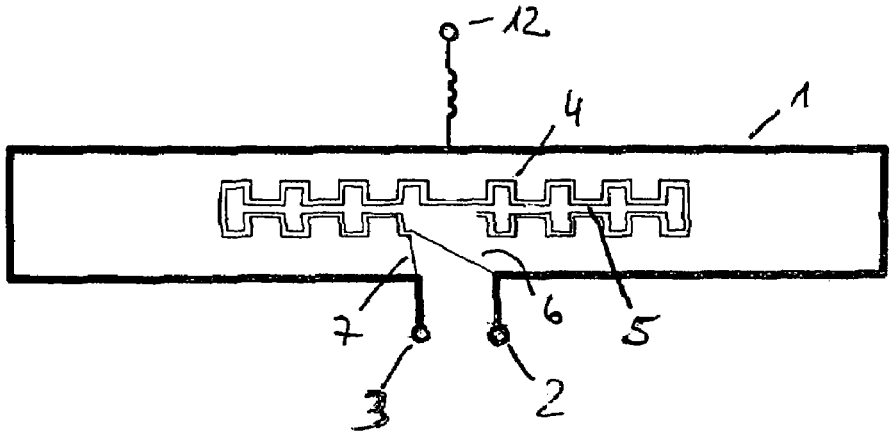
FIG. 3 shows an antenna structure according to the invention with a meandering conductor structure.

FIG. 3 shows an antenna structure according to the invention with a meandering conductor structure. The antenna structure illustrated differs from FIG. 1 in that the first line element 4 and the second line element 5 run in meandering fashion and parallel to one another within the area bounded by the radiator element 1. The first line element 4 and the second line element 5 may thus have a length that is greater than the lateral extent of the radiator element 1. As a result, the conductor structure may have a greater mechanical length than the radiator element 1. The first blocking frequency $f_{s1}$ is less than the useful frequency $f_N$.

Further measures that reduce the extent of the conductor structure are conceivable, such as, for example, a course of the first line element 4 and of the second line element 5 in the form of a fractal curve, in order to enable a blocking effect at a blocking frequency $f_{s1}$ that is small with respect to the useful frequency $f_N$.

Figure 4:
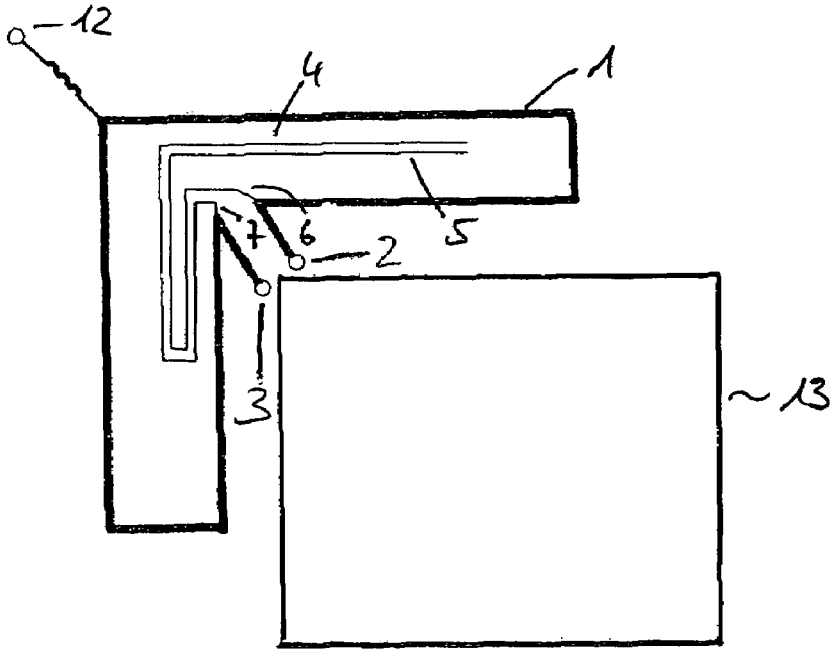
FIG. 4 shows an antenna structure according to the invention with a radiator element embodied as a folded dipole in angular form.

FIG. 4 shows an antenna structure according to the invention with a radiator element 1 embodied as a folded dipole in angular form. The antenna structure illustrated differs from FIG. 1 in that the radiator element 1 is embodied as a symmetrical angular folded dipole. The course of the first line element 4 and of the second line element 5 is correspondingly designed in angular fashion within the area bounded by the radiator element 1. The antenna structure is additionally coupled to a transmitting-receiving stage 13 by means of the first connecting terminal 2 and the second connecting terminal 3. The transmitting-receiving stage 13 has differential inputs and outputs.

In one possible embodiment, the transmitting-receiving stage 13 is an integrated semiconductor component, while the antenna structure is embodied in printed form on a printed circuit board. The transmitting-receiving stage 13 and the antenna structure can thus advantageously be arranged on the same printed circuit board. It is additionally conceivable to provide the printed circuit board, the antenna structure and the transmitting-receiving stage 13 with a common housing. A separate housing for the integrated semiconductor component is therefore not necessary.

In a second possible embodiment, the antenna structure is embodied together with the transmitting-receiving circuit in an integrated semiconductor component. The production process can thus be restricted to the production process for an integrated semiconductor device.

I claim:

1. An antenna structure for transmitting and/or receiving radio waves comprising:

a symmetrical radiator element with first and second connecting terminals, said radiator element being tuned to a useful frequency, at least one conductor structure connected in parallel with the radiator element, said conductor structure having an open-circuited first line element coupled to the first connecting terminal, and an open-circuited second line element coupled to the second connecting terminal, wherein the first and second line elements are of the same length essentially corresponding to the integral multiple of a quarter of a wavelength corresponding to a blocking frequency, and the first and the second line elements arranged in a manner running parallel to one another, and at least one second conductor structure connected in parallel with the radiator element, said second conductor structure having an open-circuited third line element coupled to the first connecting terminal, and an open-circuited fourth line element coupled to the second connecting terminal, the third and fourth line elements being of the same length essentially corresponding to the integral multiple of a quarter of a wavelength corresponding to a second blocking frequency different from the blocking frequency.

2. An antenna structure according to claim 1, wherein the radiator element is a folded dipole.

3. An antenna structure according to claim 2, wherein the radiator element is a folded dipole in angular form.

4. An antenna structure according to claim 1, wherein the radiator element is a symmetrical frame antenna with a closed border.

5. An antenna structure according to claim 1, wherein the radiator element is an approximately fractal structure generated by a finite number of iteration steps generating a partial fractal.

6. An antenna structure according to claim 1, wherein the conductor structure is an approximately fractal structure generated by a finite number of iteration steps generating a partial fractal.

7. An antenna structure according to claim 1, wherein the conductor structure comprises first and second line elements running parallel in meandering form.

8. An antenna structure according to claim 1, wherein the conductor structure is arranged within an area bounded by the radiator element.

9. An antenna structure according to claim 1, wherein the conductor structure is arranged outside an area bounded by the radiator element.

10. An antenna structure according to claim 1, wherein the radiator element is symmetrical and has a connection for feeding a DC voltage into the radiator element.

11. An antenna structure according to claim 1, wherein the antenna structure is integrated in a housing of a semiconductor component.

12. An antenna structure according to claim 1, wherein the antenna structure is in printed form on a printed circuit board.

13. An antenna structure for transmitting and/or receiving radio waves comprising:

a symmetrical radiator element with first and second connecting terminals, said radiator element being tuned to a useful frequency, at least one conductor structure connected in parallel with the radiator element, said conductor structure having an open-circuited first line element coupled to the first connecting terminal, and an open-circuited second line element coupled to the second connecting terminal, wherein the first and second line elements are of the same length essentially corresponding to the integral multiple of a quarter of a wavelength corresponding to a blocking frequency, and the first and the second line elements arranged in a manner running parallel to one another, wherein the conductor structure is arranged within an area bounded by the radiator element.

14. An antenna structure according to claim 13, further comprising at least one second conductor structure connected in parallel with the radiator element, said second conductor structure having an open-circuited third line element coupled to the first connecting terminal, and an open-circuited fourth line element coupled to the second connecting terminal, the third and fourth line elements being of the same length essentially corresponding to the integral multiple of a quarter of a wavelength corresponding to a second blocking frequency different from the blocking frequency.

15. An antenna structure according to claim 13, wherein the radiator element is a symmetrical frame antenna with a closed border.

16. An antenna structure according to claim 13 wherein the radiator element is an approximately fractal structure generated by a finite number of iteration steps generating a partial fractal.

17. An antenna structure according to claim 13, wherein the conductor structure is an approximately fractal structure generated by a finite number of iteration steps generating a partial fractal.

18. An antenna structure according to claim 13, wherein the conductor structure comprises first and second line elements running parallel in meandering form.

19. An antenna structure according to claim 13, wherein the conductor structure is arranged within an area bounded by the radiator element.

20. An antenna structure according to claim 13, wherein the conductor structure is arranged outside an area bounded by the radiator element.

21. An antenna structure according to claim 13, wherein the radiator element is symmetrical and has a connection for feeding a DC voltage into the radiator element.

22. An antenna structure according to claim 13, wherein the antenna structure is integrated in a housing of a semiconductor component.

23. An antenna structure according to claim 13, wherein the antenna structure is in printed form on a printed circuit board.

* * * * *